United States Patent [19]

Lien

[11] 4,320,375

[45] Mar. 16, 1982

[54] HIGH CURRENT UNDER OIL EXPULSION FUSE

[75] Inventor: Wayne W. Lien, Milwaukee, Wis.

[73] Assignee: RTE Corporation, Waukesha, Wis.

[21] Appl. No.: 134,966

[22] Filed: Mar. 28, 1980

[51] Int. Cl.[3] ..... H01H 85/02; H01H 85/40

[52] U.S. Cl. ..... 337/204; 337/277

[58] Field of Search ..... 337/204, 203, 205, 217, 337/218, 220, 277

[56] References Cited

U.S. PATENT DOCUMENTS 4,205,295 5/1980 Mahieu ..... 337/204

4,220,941 9/1980 Mahieu et al. ..... 337/204

*Primary Examiner*—Harold Broome

*Attorney, Agent, or Firm*—Ronald E. Barry

[57] ABSTRACT

A high current under oil expulsion fuse having a pair of contacts mounted on a dielectric sleeve, a nontracking, nonconducting pressure tube within the sleeve which extends beyond the dielectric housing into a portion of each of the contacts, a fuse link in the pressure tube, a clamp having a metering orifice mounted on one of the contacts to secure the link in the contact and a gas retention chamber mounted on the other contact to secure the link to the other contact, the gas retention chamber being operative to blow high pressure gas through the bore of the pressure tube to assist in clearing arc products and ionized gases from the fuse.

18 Claims, 3 Drawing Figures

HIGH CURRENT UNDER OIL EXPULSION FUSE

BACKGROUND OF THE INVENTION

Under oil expulsion fuses are generally used in high voltage systems to protect the electric devices from fault currents. The expulsion fuse is ideally suited for use in series with backup current limiting fuses since it can be used to provide current interruption under low fault conditions without operation of the more costly current limiting fuse. Low fault current clearing to some extent has been limited by the absence of controlled pressures within the expulsion fuse.

SUMMARY OF THE INVENTION

The under oil expulsion fuse of the present invention increases the maximum interrupting capability of an expulsion fuse to 200–300% of the existing rating. The explusion fuse described herein has the capability of clearing approximately 8,000 amps rms asymmetrical at 8.3 kv, while standard fuses have a normal capability of clearing 3,500 amps. This has been achieved by including a pressure tube within the fuse housing which increases the capability of the fuse to withstand the pressure waves caused under high fault fusing conditions. By controlling back pressure within the fuse, the fuse is capable of clearing the arc under low fault conditions. The thrust force created on discharge of gas pressure from the fuse can be reduced by including a gas atomizer on the fuse housing to disperse the gas on fusing.

BRIEF DESCRIPTION OF DRAWINGS

For a better understanding of the invention, reference may be made to the following description taken in conjunction with the following drawings, wherein.

DETAILED DESCRIPTION OF PREFERRED EMBODIMENT

Figure 1:
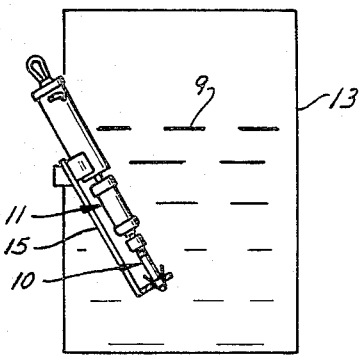
FIG. 1 is a schematic view of the expulsion fuse shown in a fuse holder and connected to a current limiting fuse.

The expulsion fuse 10 as seen in FIG. 1 is mounted on the end of a current limiting fuse 11. The combined fuses 10 and 11 are supported in an enclosure 13 by means of a fuseholder 15. The enclosure is filled with an insulating fluid 9 such as oil to insulate the enclosed electrical apparatus. The fuse 10 as seen in the drawing is totally immersed in the fluid 9.

The fuse 10, according to the present invention, generally includes a fuse assembly 12 formed from a glass wound epoxy sleeve 18 having electrically conductive contacts 20 and 22 at both ends. A fuse link 14 extends through the fuse assembly 12 and electrically interconnects the contacts 20, 22. The fuse link 14 is designed to melt under predetermined load current and/or temperature conditions to open the circuit across contacts 20, 22. A build-up of pressure will occur within the fuse assembly on fusing of the fuse link 14.

Means are provided on the fuse assembly to accumulate the high pressure gas on fusing of the fuse link 14. Such means is in the form of a pressure retention member 16 having a pressure chamber 19. The pressure retention member 16 is mounted on the contact 20. The gas pressure build-up in the fuse assembly during fusing of the link 14 will also build up pressure in the chamber 19. This high pressure gas is released at the appropriate time to blow back down through the fuse assembly 12 assisting in the clearing operation of the fuse by clearing the fuse assembly of arc products and ionized gases. The gas pressurizing the pressure retention chamber 19 is relatively clean but laced with oil vapor which is an excellent arc extinguising material.

Means are also provided to maintain a predetermined back pressure within the fuse assembly to assure fuse clearing under low fault conditions. Such means is in the form of a fuse clamp 26 mounted on contact 22. A metering orifice 28 is provided in the clamp 26 and has a size which is selected to maintain a sufficient back pressure within the fuse assembly to permit withstand of the voltage stress, until deionizing action is sufficient to prevent restrike. It is generally known that arc distance increases as pressure increases and therefore the pressure required to withstand the rated voltage stress can be determined for a given fuse.

Means are also provided within the fuse assembly 12 to aid in the fuse clearing operation. Such means is in the form of a resilient pressure tube 24 positioned within the sleeve 18 and extending beyond the ends of the sleeve 18 into the contacts 20 and 22. The pressure tube is formed of a nontracking nonconducting material, such as Teflon, to prevent arc-over on fuse clearing.

More particularly and referring to the drawings, the sleeve 18 is made in the form of a hollow tube from a high strength material having some resilience such as a fiberglass wound epoxy composition. A passage 17 is formed through the pressure tube 24. Fuse clearing action requires that the sleeve have very high hoop strength of up to 2000 psi in order to withstand the pressure created within the fuse assembly during a fuse clearing operation.

The contacts 20 and 22 are formed from an electrically conductive material, such as copper, and are wound into the ends of the sleeve 18. The contacts act as the means for making external contact to the circuit and are of sufficient mass to withstand and absorb the heat of the arc during fuse clearing without being severely damaged. Each of the contacts has a central passage 21 with an enlarged portion 23 forming a continuation of the passage 17 in pressure tube 24. A threaded section 25 is provided at the entrance to each of the contacts 20, 22. A slot 27 is provided at the entrance to each of the contacts 20 and 22 to accommodate the ends of the fuse link 14.

A void-free connection is provided between the contacts 20, 22, the pressure tube 24 and the sleeve 18. This is accomplished by inserting the pressure tube 24 into the bore 23 of contacts 20 and 22 with an interference fit. The sleeve 18 is then wound directly onto the tube 24 and contacts 20, 22. It is essential to have a void-free contact since a void may trap gas or liquid which could ionize under voltage stress causing corona and eventual failure. A void could also create an area of dissimilar dielectrics which could cause a voltage stress concentration resulting in flashover.

A nongasing and noncarbonizing, nonconducting means in the form of the pressure tube 24 is provided within the sleeve 18 which is made of a material such as Teflon. The tube 24 must withstand the high pressure shock wave created by the vaporization of the fuse link 14 and the oil present in the housing at the time of current interruption. The tube must also be capable of withstanding the high temperature of the fuse clearing operation without melting, cracking or carbonizing. Teflon is preferred because of its nontracking high temperature characteristic. However, other materials could be used which have this same characteristic. It is essential that the tube 24 not trap, hold or in any way attempt to hold any contaminating material in the tube bore 31 which could lead to a flashover between the end contacts 20 and 22.

The end of the fuse link 14 is retained in the contact 22 by means of the fuse clamp 26 which is threadedly received in the threaded portion 25 of the contact 22. The clamp 26 is used to wedge the end of the fuse link 14 against a shoulder 29 in the contact 22. The fuse clamp 26 must also be made of a material which will withstand the heat and pressure created during the fuse clearing operation without being erroded away. Means are provided in the fuse clamp 26 in the form of the metering orifice 28 to create a minimum back pressure of approximately 150 psi in the pressure tube 24 during fuse clearing. The orifice 28 is connected to the bore 31 of the pressure tube 24 through a passage 30 provided in the fuse clamp. Under low current clearing conditions, the back pressure is normally insufficient to obtain a satisfactory clearing of arc products from the fuse assembly. By providing the metering orifice 28 in the fuse clamp 26, the back pressure can be built up sufficiently to prevent restrike after the arc is extinguished at current zero.

The pressure retention member 16, includes the pressure chamber 19 and is mounted on the contact 20 by means of a threaded clamp 36 having a passage 38 and a relief port 40. The passage 38 connects the pressure chamber 19 to the bore 31 of the tube 24. The clamp 36 is screwed into the threaded section 25 of contact 20 far enough to wedge the upper end of the fuse link 14 against the shoulder 29 on the contact 20. The relief port 40 allows the fuse to fill with oil through orifice 28 when the fuse is immersed in oil. It is important to the operation of the gas pressure retention member 16 to maintain air in the chamber 19. This is accomplished by positioning the retention member 16 above the port 40 at all times. As gas pressure is built up within the tube 24, the pressure within the chamber 19 will increase. When the pressure drops in the bore 31, the high pressure gas in the chamber 19 will discharge through the bore 31, and orifice 28 in clamp 26 to clear the fuse of arc products and ionized gases. The volumetric ratio between the retention chamber and the fuse will vary depending on fuse size. Generally its chamber should be larger than the fuse. However, a volumetric ratio of 10 to 1 between the retention chamber 19 and the fuse 10 has been found to be satisfactory for a 15.5 kv, 2000 amp interruption.

Figure 3:
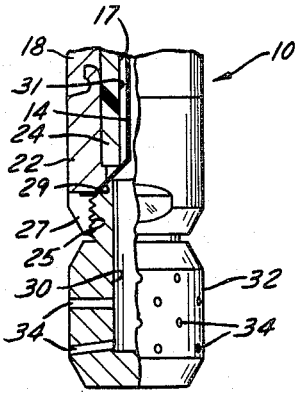
FIG. 3 is a partial view of the expulsion fuse with an atomizer fuse clamp mounted on the end of the fuse.
Figure 2:
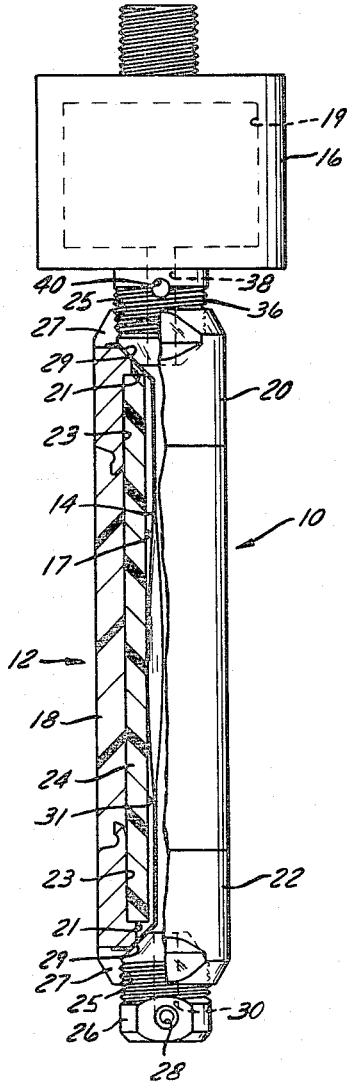
FIG. 2 is an elevation view partly in section showing the pressure tube in the fuse.

A further consideration for the fuse clamp 26 is to reduce the total violence of the fuse clearing operation. When an under oil expulsion fuse opens a large volume of gas is produced due to vaporization of the fuse link and the surrounding oil. A large hot bubble is formed when this gas is driven out of the fuse holder through the orifice 28 in the clamp 26. This problem can be eliminated by providing an atomizing means in the form of a fuse clamp gas atomizer 32, as seen in FIG. 3, for the fuse clamp 26. The gas atomizer 32 includes a plurality of orifices 34 which are in communication with the passage 30. The atomizer thus causes the high pressure gas discharged from the fuse to be broken down into many fine sprays of gas which are sprayed into the oil surrounding the electrical device where it is cooled and ultimately condensed. The orifice size and number must be calculated to produce a back pressure of about 150 psi in order to achieve proper low current clearing of the fuse.

The gas atomizer 32 can also be used to reverse the direction of discharge of the gas so the force of gas discharge pulls the expulsion fuse assembly into the fuse holder during a clearing operation. In this regard, if the fuse is used in a bayonet-type fuse holder, the force of the gas discharging through the orifices can cause the fuse to be forced out of the fuse holder. By reversing the direction of the orifices, the gases will create a force opposing the removal of the fuse assembly from the bayonet fuse holder. Under this situation the more force that is developed during clearing operation, the greater the force holding the fuse in the tank.

In operation, when the fuse link 14 melts and arcing occurs, the fuse link and surrounding oil vaporize causing a rapid increase of pressure in the fuse. The initial increase of pressure is absorbed by the pressure tube 24 which is reinforced by the outer sleeve 18. The gas will expand in both directions from the arc, producing an increase in pressure in both the pressure chamber 19 and the fuse clamp 26. Part of this gas will escape through the metering orifice 28 in the fuse clamp 26 and a small amount through the relief port 40 in clamp 36. Proper selection of the flow rate through orifice 28 is essential to maintain the proper back pressure in the fuse to allow for low current fuse clearing. Gas which is forced up into the retention chamber 19 will remain in the chamber until the fuse tube pressure drops. A drop in pressure will occur as the current cycle approaches current zero which extinguishes the arc. At current zero the arc goes out and the arc pressure drops. As the pressure in the bore 31 drops the gas in the pressure retention chamber 19 begins to blow down through the bore 31 flushing the arc residue and ionized gases out through the fuse clamp 26. As the pressure is reduced in the bore 31 of the tube 24, oil will again flow into the bore 31 through orifice 28 forcing any remaining air out through relief port 40. It should be noted that the oil will not enter the chamber 19 because the port 40 is located below the chamber 19 in the oil.

The fuse 10 can be reactivated by removing the clamps 26 and 36 from the contacts 22 and 20, respectively. A new fuse link 14 is inserted into the bore 31 of the tube 24 and ends of the link 14 positioned in slots 27. The clamps 26 and 36 are then replaced to wedge the link 14 into position in the contacts.

The embodiments of the invention in which an exclusive property and privilege is claimed are defined as follows:

1. A high current under oil expulsion fuse comprising a hollow tubular assembly having an electrically conductive contact at each end, a fuse link supported within the assembly and being connected to each of said contacts, a gas pressure retention chamber supported on one end of said housing, and a gas pressure discharge means in the opposite end of said housing whereby gas pressure built up in the retention chamber on fusing of the fuse link will blow back through the discharge means in the housing when the pressure drops in the assembly to clear the assembly of arc products.

2. The fuse according to claim 1, wherein nontracking, nonconducting means are provided within said assembly to prevent flashover.

3. The fuse according to claim 2, wherein said nontracking means comprises a resilient nongasing, noncarbonizing, nonconducting tube.

4. The fuse according to claims 1, 2 or 3, wherein said discharge means at the opposite end of said housing includes a metering orifice for maintaining back pressure within said housing.

5. The fuse according to claim 4, wherein said discharge means comprises a fuse clamp at the end of said housing, said clamp including said metering orifice to control the rate of discharge of gasses from said housing.

6. The fuse according to claim 4, wherein said discharge means comprises an atomizing fuse clamp having a plurality of metering orifices to atomize the gases on discharge from the fuse assembly.

7. The fuse according to claim 6, wherein said orifices are directed in a reverse direction to the direction of removal of the fuse.

8. A high current under oil expulsion fuse comprising a fuse assembly including a pair of electrical contacts, a fiberglass epoxy sleeve supporting said contacts in a spaced relation, a fuse link within said sleeve, means for clamping the fuse link to the contacts, a resilient pressure tube on the inside of said sleeve and extending beyond the sleeve into the contacts and means mounted on one of said contacts for retaining gas under pressure during a clearing operation and discharge means in the other of said contacts whereby on reduction of arc pressure in the pressure tube, retained gas will blow back through the fuse assembly.

9. The fuse according to claim 8, wherein said discharge means comprises a metering orifice in said clamp means for maintaining sufficient back pressure in said fuse assembly to permit withstand of the voltage stress, until deionizing action is sufficient to prevent restrike.

10. The fuse according to claim 8, wherein said discharge means comprises a plurality of metering orifices in said clamp means.

11. The fuse according to claim 10, wherein said orifices are arranged to direct the high pressure gases in a direction which will create a force opposing the removal of the fuse assembly.

12. The fuse according to claim 8, wherein said pressure retaining means has a volume greater than the volume of the fuse.

13. A high current under oil expulsion fuse comprising a resilient pressure tube, a pair of electrical contacts mounted on the ends of the tube, a fiberglass epoxy sleeve wound around said tube and portions of said contacts, a fuse link extending through said tube with the ends of the link overlapping the contacts, a fuse clamp secured to one of said contacts in a position to clamp one of the ends of the link into electrical engagement with the contacts, a pressure retention member secured to the other contact in a position to clamp the other end of the link to the contact, said retention member including a chamber for accumulating gas under pressure during a fuse clearing operation, and said fuse clamp including means for restricting gas flow from said fuse during a fuse clearing operation and allowing for gas under pressure in said retention member to blow back through said tube after the fuse clearing operation.

14. The fuse according to claim 13, wherein said sleeve is wound on said contacts and said tube with a void free bond.

15. The fuse according to claim 13, wherein said retention member includes a relief orifice to allow the fuse to fill with oil.

16. The fuse according to claim 13, wherein said fuse clamp restricting means comprises a metering orifice of a size sufficient to maintain a back pressure in said fuse to permit withstand of the voltage stress until deionizing action is adequate to prevent restrike.

17. The fuse according to claim 13, wherein said fuse clamp restricting means comprises a plurality of orifices.

18. The fuse according to claim 13, wherein said tube is formed of a nontracking, nonconducting material.

* * * * *